US006558173B1

(12) United States Patent
Choy

(10) Patent No.: US 6,558,173 B1
(45) Date of Patent: May 6, 2003

(54) CARD EDGE CONNECTOR WITH COMMONING CONTACTS AND INDIVIDUAL CONTACTS AND METHOD MAKING THE SAME

(75) Inventor: Edmond Choy, Union City, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/043,538

(22) Filed: Jan. 8, 2002

(51) Int. Cl.[7] ..... H01R 31/08
(52) U.S. Cl. ..... 439/108; 439/637; 439/507
(58) Field of Search ..... 439/108, 101, 439/637, 636, 567, 571, 572, 189, 507, 510

(56) References Cited

U.S. PATENT DOCUMENTS 4,487,464 A * 12/1984 Kirschenbaum
4,996,766 A * 3/1991 Piorunneck et al. ..... 439/637
5,007,888 A * 4/1991 Goutiere ..... 439/189
5,112,239 A * 5/1992 Yagi et al. ..... 439/189
5,326,276 A * 7/1994 Cheng ..... 439/326
6,024,597 A * 2/2000 Lok ..... 439/497
6,113,404 A * 9/2000 Choy ..... 439/160
6,162,102 A * 12/2000 Choy ..... 439/751

* cited by examiner

*Primary Examiner*—Gary Paumen
(74) *Attorney, Agent, or Firm*—Wei Te Chung

(57) ABSTRACT

A card edge connector includes an insulative housing defining a central slot along a longitudinal direction thereof. Two rows of passageways are disposed by two sides of the central slot, respectively. An elongated slit is formed in an outer side of each corresponding row of the passageways. A contact strip is retained in the corresponding slit and laterally communicating with some corresponding designated passageways. A plurality of discrete first contacts are retainably received within such some designated passageways, respectively, and a plurality of second contacts are respectively retainably disposed in the remaining passageways.

11 Claims, 4 Drawing Sheets

CARD EDGE CONNECTOR WITH COMMONING CONTACTS AND INDIVIDUAL CONTACTS AND METHOD MAKING THE SAME

BACKGROUND OF THE INVENTION

1. Field of The Invention

The invention relates to card edge connectors, and particularly to the card edge connector with individual signal contacts and commoning power contacts and the method making the same.

2. The Related Arts

Card edge connectors are popularly used in the computer industry, for example, Micro Channel connectors (e.g., U.S. Pat. No. 5,326,276), EISA connectors (e.g., U.S. Pat. No. 4,996,766) and DIMM connectors (e.g., U.S. Pat. No. 6,113,404), etc. The contacts used in the card edge connectors generally include two types of which one is the so-called forming type in which the curved contact portion is successively bent/formed after the individual contact has been stamped from the metal sheet, and the other is the so-called blanking type in which the curved contact portion generally is directly formed when the individual contact is being stamped from the metal sheet.

The advantage of the former is to own the superior resiliency and the contacts on the same side of the connector housing can be commonly formed on the same carrier and simultaneously inserted into the corresponding passageways. For example, the aforementioned U.S. Pat. No. 4,996,766 discloses a card edge connector, i.e., the EISA connector, with two level contacts which are of the so-called forming contacts arranged on the same contact carrier and adapted to be inserted into the corresponding passageways of the housing at one time.

Oppositely, the advantage of the latter is to own the more precise shape of the contacts than the forming type, and have only one step, i.e., direct stamping, to form each individual contact rather than two steps, i.e., one stamping plus one forming, required by the forming type one. For example, U.S. Pat. No. 6,162,102 discloses the so-called blanking type in which the odd configuration of the curved contact portion or even the dual-beam contact portion can be achieved. The presently preferred embodiment of the invention depicted later is related to the blanking type contact. As shown in FIG. 1, the conventional blanking type contacts 1 in the card edge connector 2, e.g. the DIMM connector, generally are symmetrically located by two sides of the central slot 3 where the daughter board (not shown) is received.

From another viewpoint, in some applications some of the individual contacts in the connector are expected to be electrically connected. Under such a condition, the jumper strip(s) or the shunting bar(s) is/are intentionally applied to the connector for implementation of commoning such specific contacts, for example, U.S. Pat. No. 4,487,464 (the card edge connector) and U.S. Pat. No. 6,024,597 (the cable connector).

The invention is to provide a card edge connector with some commoned designated contacts in an easy manufacturing way.

SUMMARY OF THE INVENTION

According to an aspect of the invention, a card edge connector includes an insulative housing defining a central slot along a longitudinal direction thereof. Two rows of passageways are disposed by two sides of the central slot, respectively. An elongated slit is formed in an outer side of each corresponding row of the passageways. The slit is configured to laterally communicate with some designated passageways in the corresponding row. A contact strip includes a elongated strip retention portion retained in the corresponding slit. A plurality of discrete first contacts are respectively retainably disposed in such some designated passageways with engagement sections mechanically and electrically engaged with the contact strip. A plurality of discrete second contacts are respectively retainably disposed in the remaining passageways. A pair of metal hold-downs are positioned at two opposite longitudinal ends of the housing and mechanically and electrically engaged with the contact strip.

DETAILED DESCRIPTION OF THE PREFERRED EMBODIMENTS

References will now be in detail to the preferred embodiments of the invention. While the present invention has been described in with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

Figure 1:
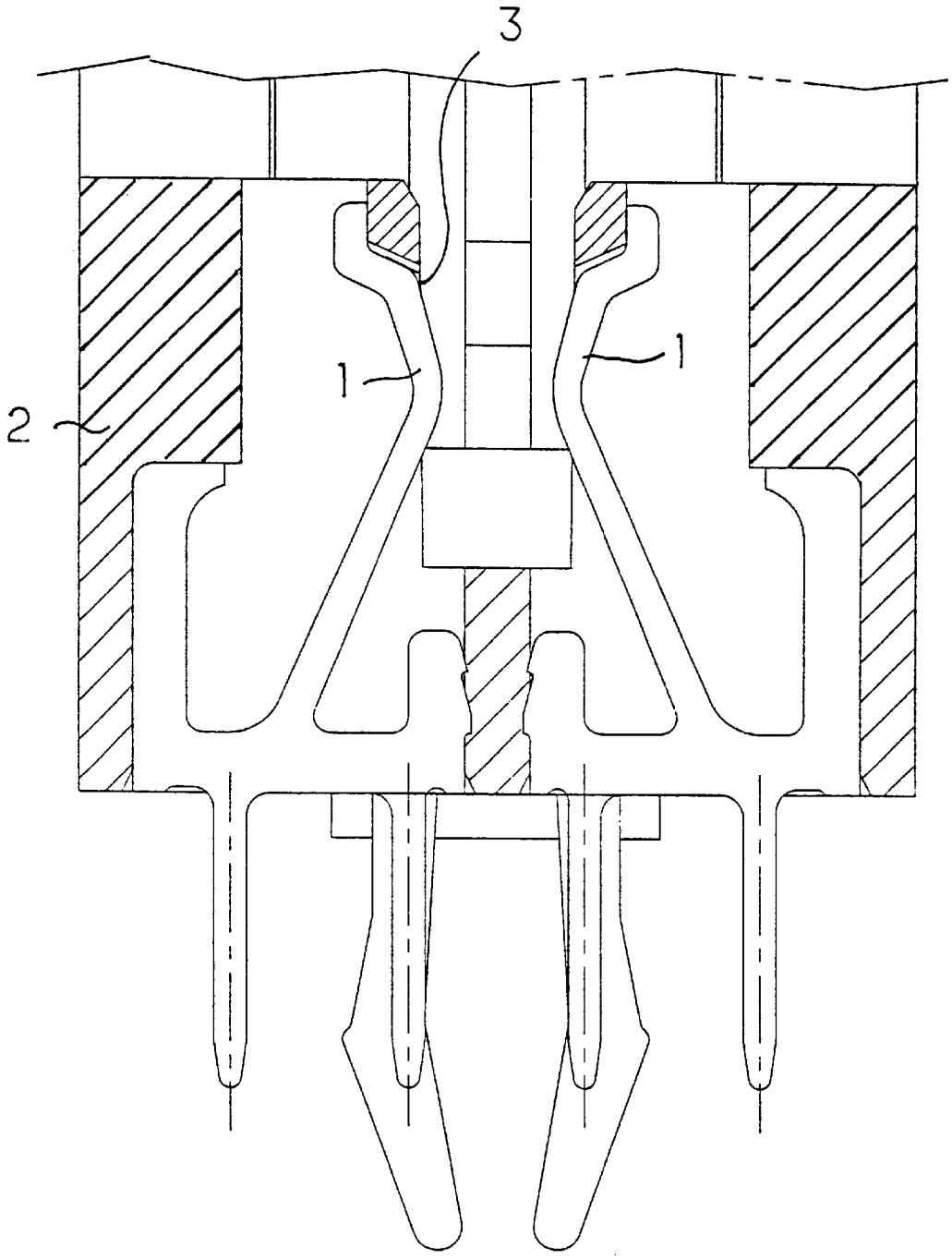
FIG. 1 is a cross-sectional view of the conventional connector with the blanking type contacts therein.
Figure 2:
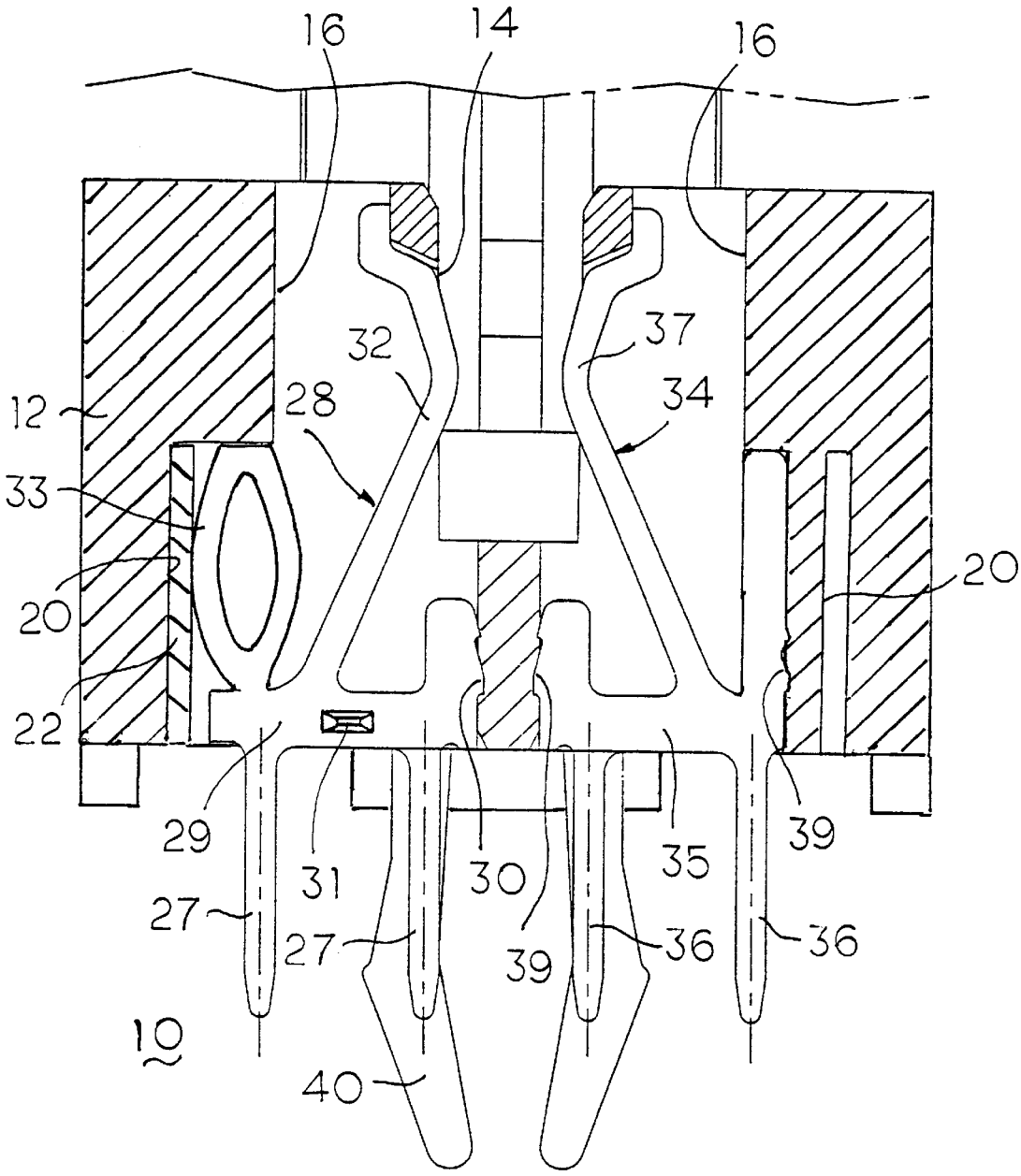
FIG. 2 is a cross-sectional view of the connector of the invention where in such a specific cross-section the right side shows the first contact electrically and mechanically engaged with the corresponding contact strip while the left side shows the second contact isolated from the slit and the corresponding contact strip (not shown).
Figure 3:
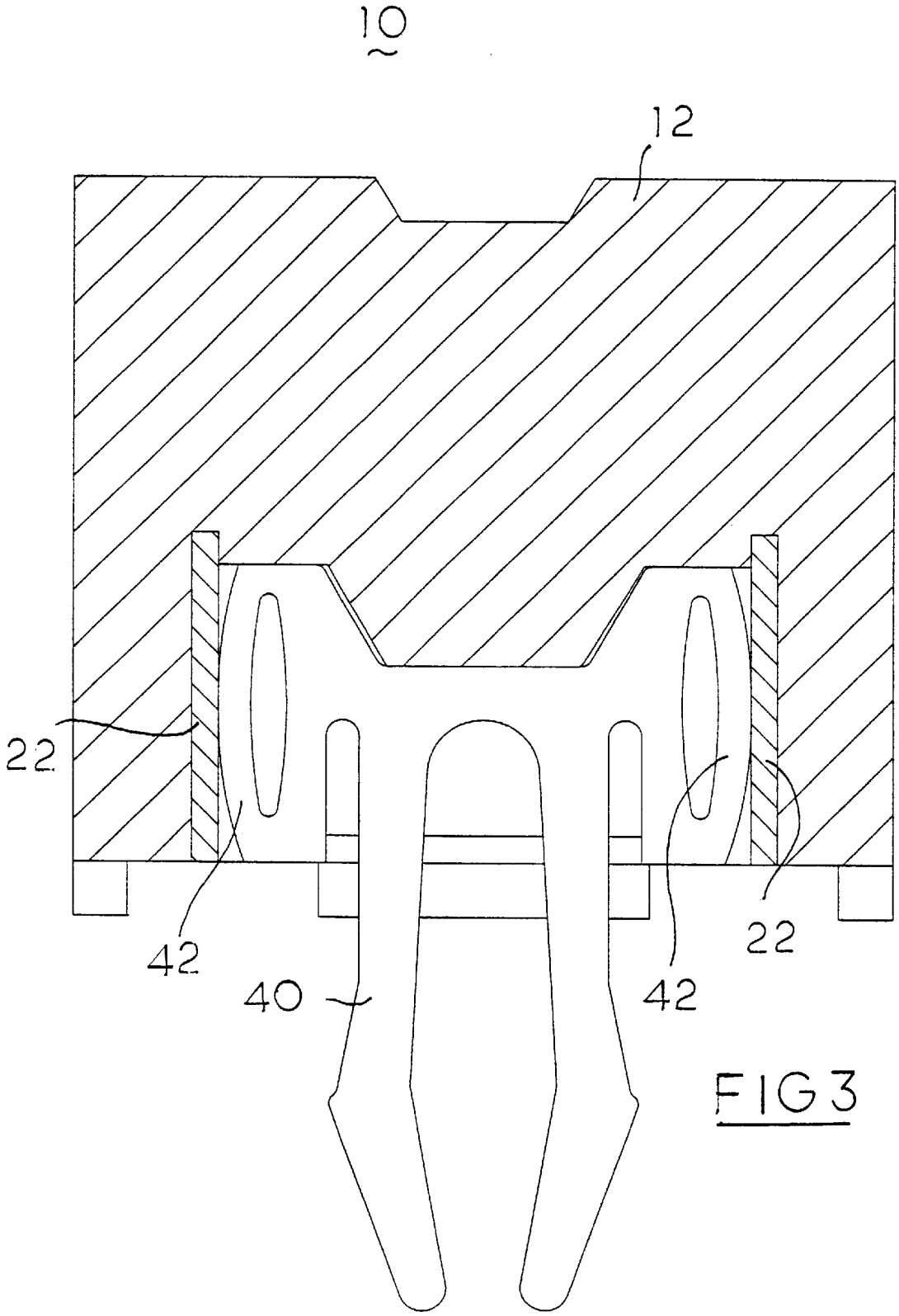
FIG. 3 is a cross-sectional view of the connector of the invention to show the metal hold-down mechanically and electrically engaged with the contact strips.
Figure 4:
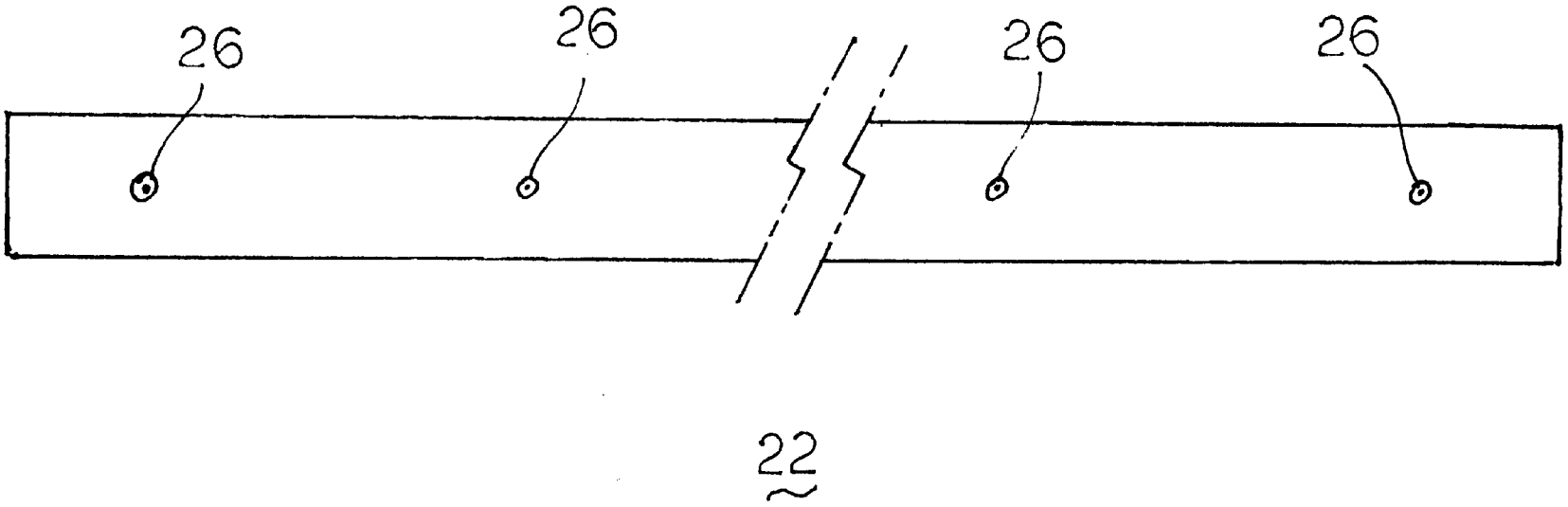
FIG. 4 is a plan view of the contact strip to show the retention embossments thereon.

It will be noted here that for a better understanding, most of like components are designated by like reference numerals throughout the various figures in the embodiments. Attention is directed to FIGS. 2–4, wherein a DIMM connector 10 includes an insulative housing 12 with a central slot 14 extending along a longitudinal direction thereof. The basic structures of the DIMM connector could be referred to the aforementioned U.S. Pat. No. 6,113,404. Two rows of passageways 16 are formed by two sides of the central slot 14. A pair of ejectors (not shown) are disposed at two opposite longitudinal ends of the housing 12 for ejection of the inserted daughter board (not shown) out of the central slot 14.

An elongated vertical slit 20 is formed on an outer side of each row of the passageways 16. The slit 20 are arranged to laterally communicate with some designated passageways 16. A contact strip 22 with the retention embossments 26 thereon is retainably received in each corresponding elongated slit 20.

A plurality of first contacts 28 are respectively individual retainably received within the corresponding passageways 16. Each of the first contacts 28 includes a first base 29 with first barbs 30 and protrusions 31 thereon for interferential engagement within the corresponding passageway 16. A first contact portion 32 upwardly extends from the first base 29 and into the central slot 14 for engagement with the inserted daughter board (not shown). A resilient engagement section 33 extends from the first base 29 and mechanically and electrically engages the contact strip 22. A first tail 27 downwardly extends from the first base 29.

Differently, a plurality of discrete second contacts 34 are respectively and individually retained and disposed in the corresponding remaining passageways 16. Each second contact 34 includes a second base 35 with second barbs 39 thereon for interferential engagement within the corresponding passageway 16. The second contact portion 37 upwardly extends from the second base 35 and a second tail 36 downwardly extend from the second base 35. The second contact 34 is isolated from the slit 20 and the corresponding contact slit 22 aside.

A pair of metal hold-downs 40 are disposed at two opposite longitudinal ends of the housing with resilient engaging device 42 to mechanically and electrically engage with the two opposite longitudinal ends of the contact strip 22 for establishing electrical connection among the first contacts 28 and the hold-downs 40.

It is also noted that only few first contacts 28 are disposed in the housing 12 in comparison with the second contacts 34, wherein the contact portions 32 of the first contacts 28 and the contact portions 37 of the second contacts 34 still keep the same contour with each other as the traditional DIMM connector, and that all the tails regardless of the first tails 27 and the second tails 36, are still arranged in a staggered manner for compliance with the layout of the printed circuit board on which the DIMM connector 10 is mounted. In other words, the first tails 27 may be either in an inner position or in an outer position, depending upon the odd numbers or the even numbers of the positions the first contacts 28 are disposed at along the longitudinal direction of the housing 12, and similarly the second tails 36 follow the same rule.

In this invention, the first contacts 28 are different from the second contacts 34 for compliance with the corresponding passageways 16 which are somewhat different from those for the second contacts 34 to mechanical and electrical engage the plate-like contact strip 22 wherein the contact strip 22 is not exposed toward an exterior once the connector 10 is mounted on the printed circuit board (not shown).

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, person of ordinary skill in this field are to understand that all such equivalent structures are to be included in the scope of the following claims.

I claim:

1. A card edge connector comprising:

an insulative housing defining a central slot along a longitudinal direction thereof;

two rows of passageways formed by two sides of said central slot;

a slit formed by at least one of said rows of passageways;

a contact strip including an elongated retention portion retainably received within said slit;

a plurality of first contacts retainably received within some designated passageways, respectively, and mechanically and electrically engaged with said contact strip; and a plurality of second contacts respectively and retainably received within the remaining passageways; wherein said first contacts are structurally different from said second contacts, and each of said first contacts includes a resilient engagement section to engage the contact strip in a lateral direction.

2. The connector as described in claim 1, wherein said slit is positioned in an outer side of said at least one of said rows of passageways.

3. The connector as described in claim 1, wherein a pair of metal hold-downs are located at two opposite longitudinal ends of the housing, and said contact strip mechanically and electrically engages at least one of said pair of metal hold-downs.

4. The connector as described in claim 1, wherein said slit laterally communicates with said some designated passageways.

5. The connector as described in claim 1, wherein the remaining passageways other than said some designated passageways are isolated from the corresponding contact strip.

6. An electrical connector comprising:

an insulative housing defining a central slot along a longitudinal direction thereof;

a plurality of passageways arranged in said housing along said longitudinal direction;

a contact strip disposed beside said passageways and defining a lengthwise dimension, along said longitudinal direction, substantially equal to that of said housing;

a plurality of discrete first contacts retainably received within some corresponding passageways, respectively; and a plurality of discrete second contacts disposed in the remaining passageways, respectively; wherein said first contacts and said second contacts are mutually exclusively in the corresponding passageways, respectively, and said contact strip is of a plate-like configuration parallel to said central slot.

7. The connector as described in claim 6, wherein said contact strip is not exposed to an exterior for being seen after the connector is mounted on a printed circuit board.

8. The connector as described in claim 6, wherein a slit is defined in the housing along said longitudinal direction to receive said contact strip, and in communication with said passageways.

9. The connector as described in claim 6, wherein each of said discrete first contacts is of a unitary piece.

10. The connector as described in claim 6, wherein each of said discrete second contacts is of a unitary piece.

11. A card edge connector comprising:

an insulative housing defining a central slot along a longitudinal direction thereof;

two rows of passageways formed by two sides of said central slot;

a slit formed by at least one of said rows of passageways;

a contact strip including an elongated retention portion retainably received within said slit;

a plurality of first contacts retainably received within some designated passageways, respectively, and mechanically and electrically engaged with said contact strip;

a plurality of second contacts respectively and retainably received within the remaining passageways; and a pair of metal hold-downs located at two opposite longitudinal ends of the housing; wherein said contact strip mechanically and electrically engages at least one of said pair of metal hold-downs.

* * * * *